US009790699B2

(12) United States Patent
Mjelde

(10) Patent No.: US 9,790,699 B2
(45) Date of Patent: Oct. 17, 2017

(54) CHANNEL DRAIN WITH WATER STOP

(71) Applicant: Olaf Mjelde, San Diego, CA (US)

(72) Inventor: Olaf Mjelde, San Diego, CA (US)

( * ) Notice: Subject to any disclaimer, the term of this patent is extended or adjusted under 35 U.S.C. 154(b) by 0 days.

(21) Appl. No.: 14/098,477

(22) Filed: Dec. 5, 2013

(65) Prior Publication Data

US 2014/0157510 A1 Jun. 12, 2014

Related U.S. Application Data

(60) Provisional application No. 61/734,267, filed on Jun. 12, 2012.

(51) Int. Cl.
*E04H 4/00* (2006.01)
*E04H 4/12* (2006.01)

(52) U.S. Cl.
CPC ..... *E04H 4/1236* (2013.01); *Y10T 29/4998* (2015.01)

(58) Field of Classification Search
CPC ..... E04H 4/1236; E04H 4/1227
USPC ..... 4/504, 510
See application file for complete search history.

(56) References Cited

U.S. PATENT DOCUMENTS

| | | | | |
|---|---|---|---|---|
| 4,815,888 | A | 3/1989 | Stegmeier | |
| 5,729,937 | A * | 3/1998 | Mantelli | 52/220.5 |
| 5,971,662 | A * | 10/1999 | Becker | E03F 3/046 404/2 |
| 6,170,095 | B1 | 1/2001 | Zars | |
| D663,387 | S | 7/2012 | Mjelde | |
| 8,474,068 | B2 * | 7/2013 | Kik, Sr. | E03F 3/046 4/613 |
| 9,200,464 | B1 * | 12/2015 | Blake | E04H 4/00 |
| 2006/0015996 | A1 * | 1/2006 | Goettl | E04H 4/12 4/507 |
| 2007/0266489 | A1 * | 11/2007 | Martin | E04H 4/1236 4/507 |

* cited by examiner

*Primary Examiner* — Christine Skubinna
(74) *Attorney, Agent, or Firm* — Rosenberg, Klein & Lee

(57) ABSTRACT

A channel drain with a water stop is adapted for handling pool water in a swimming pool having a plastered surface. The channel drain, preferably a sump drain includes an elongated channel having a drain port and an opening for receiving pool water. A water stop abutting and substantially encircling the opening is formed into a trough for retaining and collecting the pool water. The drain is configured for installation in a pool with the water stop buried in the plastered surface, such that pool water seeping between the opening and the plaster is trapped by the trough, preventing the pool water from intruding beyond the plastered surface.

9 Claims, 3 Drawing Sheets

CHANNEL DRAIN WITH WATER STOP

This application claims the benefit of priority filing date of provisional patent application No. 61/734,267, filed Dec. 6, 2012.

BACKGROUND

Pool drains, or sumps, as currently known in the art comprise a plastic or fiberglass body, including a chamber into which water flows from the pool as it gets recycled through the pool's pump and filter. The chamber includes an opening, or sump port, that connects to a pipe in communication with the pool pump and filter apparatus. Pipes are typically installed in gunite or shotcrete material forming the supporting walls of the pool. The terminal end of a pipe is then encased in plaster along with the drain to which it is connected. The plaster covers the gunite or shotcrete and serves as a barrier between water in the pool and the gunite or shotcrete.

Elongated channel sumps are popular in view of their compliance with the Virginia Graham Baker Pool & Spa Safety Act ("VGB Act"), requiring swimming pool and spa sumps to prevent a person's body from covering the entire sump intake and becoming entrapped. Anti-entrapment channel sumps generally comply with the VGB Act by providing multiple intake ports or being of a sufficient length that they cannot be simultaneously blocked, i.e., if one sump port or a portion is blocked, the other sump ports or other portions allow water to continue to flow into the pump and filter intake.

U.S. Pat. No. 4,815,888 to Stegmeier teaches a swimming pool drain for decking areas of a swimming pool. The drain is an elongated trough and is formed of parallel spaced-apart side walls. A grating with apertures allows water to travel into the trough for draining. Due to the elongated shape of the drain, occlusion of apertures in one area still allows water to drain through adjacent open apertures, preventing the drain from easy obstruction.

U.S. Pat. No. 6,170,095 to Zars discloses an elongated drain to distribute the suction flow of water over a large surface area and utilizes a bendable or deformable upwardly releasable grate with slots. In this manner, when some slots are obstructed, other slots allow water to pass through. Additionally, the bowing effect of the grate allows it to be easily removed for cleaning.

U.S. App. No. 2007/0266489 to Martin discloses a trough with an elongated drain inlet. The trough has a non-snaring surface and the elongated inlet allows one portion of the inlet to be obscured, while allowing water to travel through an open portion. All of these references teach an elongated entrance to a drain, but only have a single outlet, which, if blocked, renders the drain inoperable.

A problem with the new VGB Act compliant swimming pool drains disclosed in the art, particularly those with larger, elongated channel sumps, is that cracks are more likely to form in the plaster which they are embedded in, in particular where the pool sump and plaster meet. This is due to the enlarged circumference and longer interface between the plaster surface of the pool and the edge of these types of drains. Consequently water may seep into the surrounding plaster and then down into the supporting walls of the pool, causing damage. It would therefore be desirable to provide such a pool sump that prevents water from migrating down cracks as they form in the plaster surrounding it.

SUMMARY

A sump drain for handling pool water in a swimming pool having a plastered surface is disclosed. The sump drain, preferably a channel drain, includes an elongated channel having a drain port and an opening for receiving the pool water. A water stop abuts and substantially encircles the opening. The water stop is formed as a trough for retaining and collecting the pool water, and the sump drain is configured for installation in the pool with the water stop buried in the plastered surface, such that the pool water seeping between the opening and the plaster is trapped by the trough, thereby preventing the pool water from intruding beyond the plastered surface.

Preferably the sump drain has elongated channel with multiple drain ports. The trough may include a substantially horizontal member extending from the elongated channel, and a substantially vertical member extending upwardly from the horizontal member. Additionally, the opening may include a rim extending upwardly from the elongated channel. The trough is disposed below the rim.

One method of using the sump drain to prevent pool water from intruding into a supporting wall, in a plastered pool adjacent a pool drain, includes providing an elongated channel drain with an opening for receiving the pool water and surrounding and abutting the opening with a trough. The drain is secured to the supporting wall and the drain and the trough are substantially surrounded with plaster. In this manner, the pool water is unable to seep between the pool drain and the surrounding plaster.

REFERENCE NUMBERS

Figure 1:
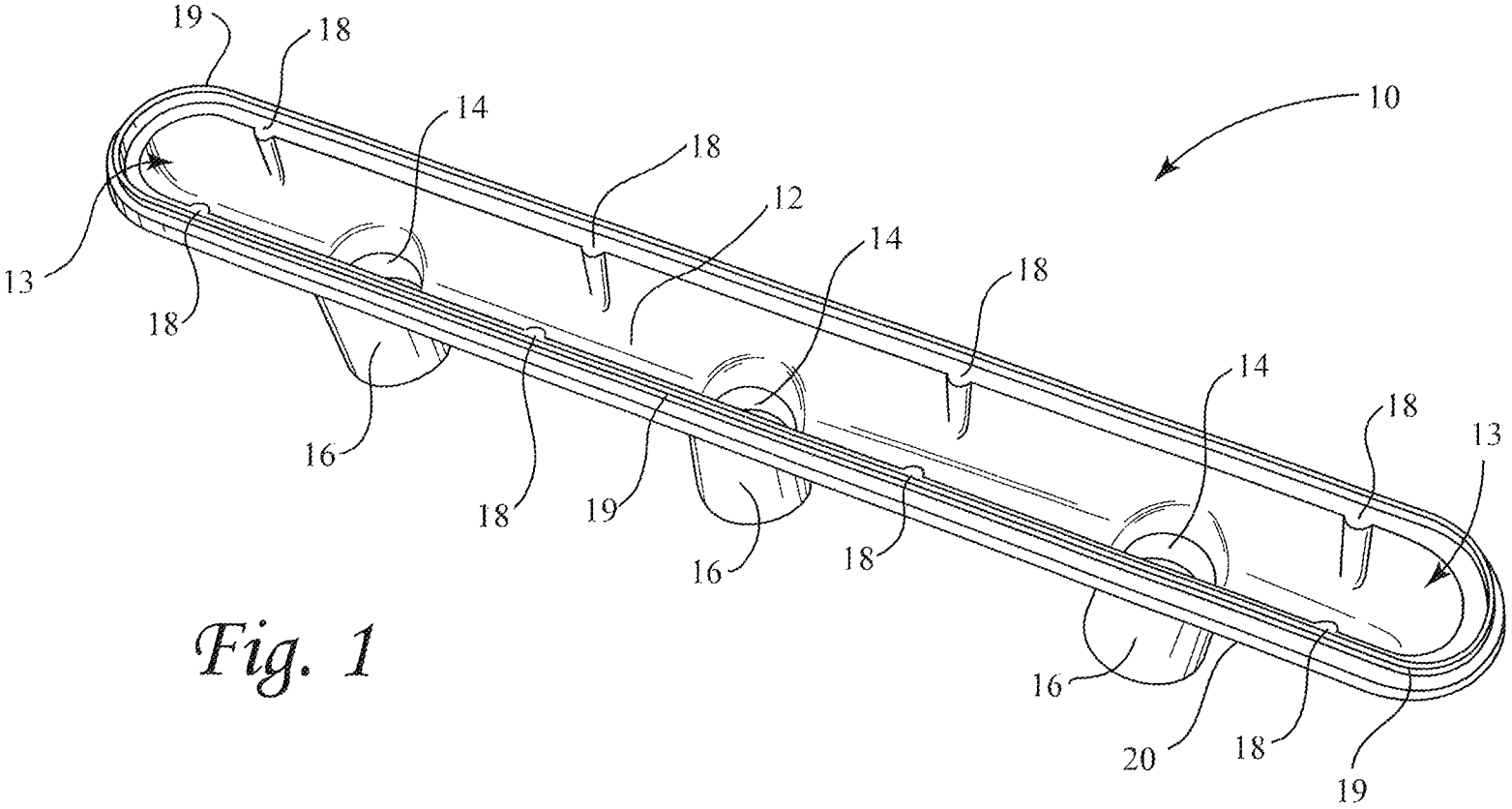
FIG. 1 is a perspective view of a channel sump drain with a water stop having three ports.

10. sump drain
12. elongated channel
13. opening
14. sump ports
16. tubes
18. anchoring points
19. rim
20. water stop
22. pool plaster
24. drain pipes
26. mortar (shotcrete)
28. threads
30. horizontal shelf
32. vertical wall

DESCRIPTION

Referring to FIG. 1, a preferred embodiment of a channel-shaped swimming pool sump drain 10 is shown and described. The sump drain 10 comprises an elongated cymbiform channel 12, having an opening 13 and multiple sump ports 14 along the elongated channel 12. The sump ports 14 are formed by tubes 16, which depend from the elongated channel 12. In the illustrated embodiment, three (3) evenly spaced sump ports 14 and tubes 16 are shown. In other contemplated embodiments, the sump drain 10 may comprise a different number of sump ports 14 and tubes 16 with alternative spacing. The sump drain 10 may also include anchoring points 18 around its rim 19 on the elongated channel 12 side of the rim 19, for alternatively anchoring the sump drain 10 in place once installed, or securing a drain cover (not shown) to the sump drain 10.

Still referring to FIG. 1, the sump drain 10 comprises a water stop 20 surrounding the opening 13 for collecting any water (not shown) that intrudes between the sump drain 10 and the pool plaster 22 (shown in FIG. 4) into which the sump drain 10 is installed. In a preferred embodiment the water stop 20 is formed as a trough or gutter extending around the sump drain 10 to collect water seeping into cracks at any point between the sump drain 10 and the pool plaster 22. The water stop 20 also serves to anchor the sump drain 10 in the pool plaster 22.

Figure 2:
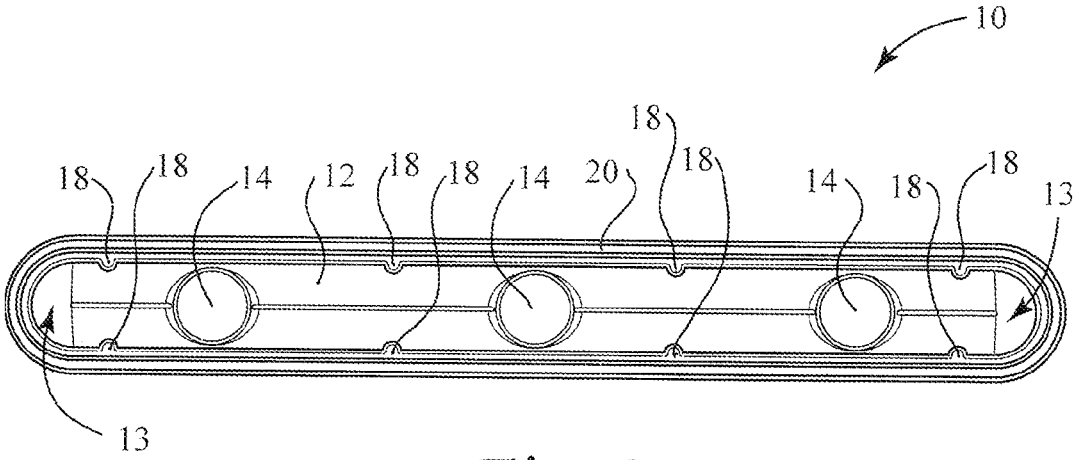
FIG. 2 is a side view of a channel sump drain with a water stop having three ports.
Figure 3:
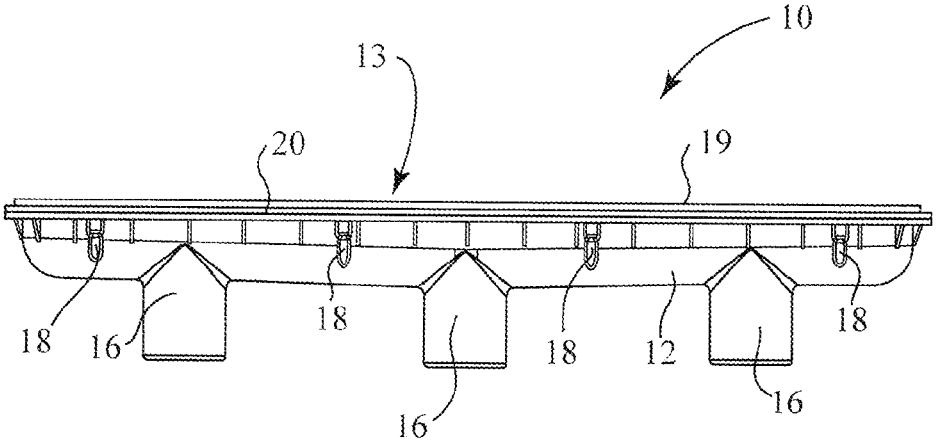
FIG. 3 is a plan view of a channel sump drain with a water stop having three ports.

Referring to FIG. 2, a top plan view of the sump drain 10 shows the water stop 20 extending around the sump drain 10 outside the rim 19. FIG. 2 also shows the anchoring points 18 and sump ports 14. Referring to FIG. 3, a side view of the sump drain 10 shows the tubes 16 which form the sump ports 14 (not shown) descend from the sump drain 10. By having multiple tubes 16, if one sump port 14 becomes obstructed, water may travel through the other sump ports 14 to avoid obstructing the sump drain 10. Still referring to FIG. 3, in one preferred embodiment, the sump drain 10 is approximately 32 and 29/32 inches long, the distance from the top of the sump drain 10 to the bottom of the sump ports 14 is 5 and ½ inches, and the distance between sump ports 14 is 10 inches.

Figure 4:
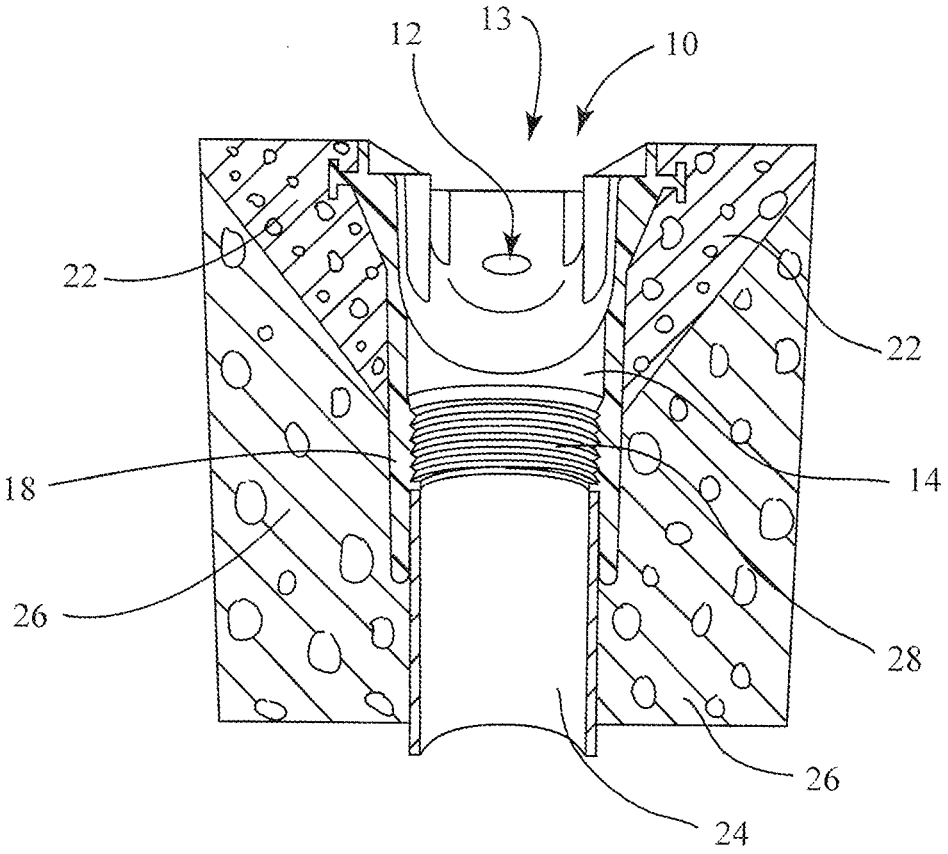
FIG. 4 is a cut-away view of a channel sump drain with a water stop installed in pool plaster.

Referring to FIG. 4, an installed sump drain 10 is shown in cut-away view. The sump drain 10 is installed on drain pipes 24 leading to a pool filter (not shown). Preferably the drain pipes 24 are installed in mortar 26 or shotcrete (also known as GUNITE®) as is customary in typical pool installations with plaster 22 installed over the mortar 26 to encase the water stop 20. In one embodiment the sump ports 14 may comprise threads 28 for engaging the tubes 16 and drain pipes 24. Note that only one tube 16 and drain pipe 24 is shown since the illustrated view is a lengthwise side view.

Figure 5:
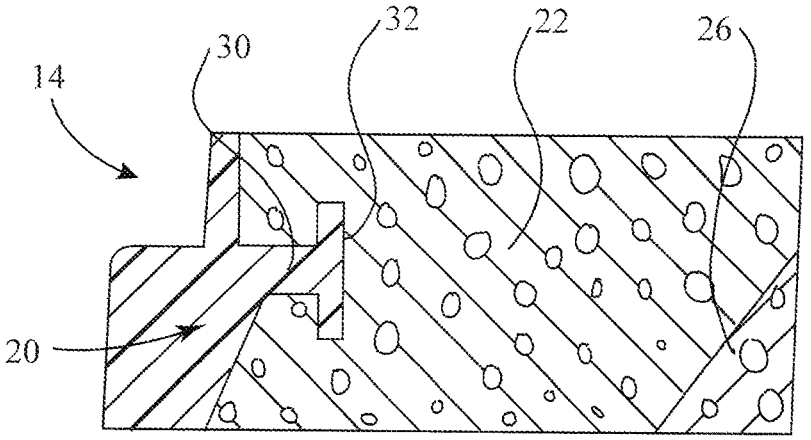
FIG. 5 is a partial cut away view of the channel sump drain showing the water stop.

Referring to FIG. 5, a close up view of the water stop 20 is shown in cut-away profile. In the illustrated embodiment, the water stop 20 comprises a horizontal shelf 30 extending around the sump drain 10. A vertical wall 32 is included at the end of the horizontal shelf 30 to catch water (not shown) migrating between the sump drain 10 and the plaster 22 in which the sump drain 10 is installed. The vertical wall 32 may extend above and below the horizontal shelf 30, providing an effective anchoring mechanism in the plaster 22 for the sump drain 10 as well, during and after installation.

With the sump drain 10 having multiple sump ports 14 installed in a pool or spa (not shown), one or more sump ports 14 may be blocked while allowing the sump drain 10 to function normally by pulling water (not shown) through the other sump ports 14. Over time, as water intrudes between the sump drain 10 and the pool plaster 22, water is captured in the water stop 20. The water stop 20 provides for a longer functional life of the sump drain 10, and also helps secure the sump drain 10 in place in the plaster 20.

In order to make and use the sump drain 10 to prevent water from intruding adjacent a pool drain in a plastered pool, the sump drain 10 is first formed by creating an elongated channel 12 having an opening 13. The elongated channel 12 is also formed with a water stop 20 surrounding the opening 13, and at least one, but preferably three or more drain ports 14 formed along the elongated channel 12. The entire sump drain 10 may be made in a molding process using a PVC, ABS or similar plastic-like durable material.

Once the sump drain 10 is formed, the drain ports 14 may be secured on pool drain pipes 24, optionally by engaging threads 28 on tubes 16 of the sump drain 10 corresponding with the drain ports 14. Once the sump drain 10 is engaged with the drain pipes 24, mortar 30 (e.g., shotcrete) may be poured around the sump drain 10 and drain pipes 24 when forming the pool, and plaster 22 administered around the sump drain 10 including the water stop 20. In this manner, should water intruded between the sump drain 10 and plaster 22, the water stop 20 will hold it and prevent it from migrating farther. Additionally, the water stop 20 serves as an anchor, holding the sump drain 10 in position.

While preferred embodiments of the present invention have been described While the apparatus and method have been described in detail with reference to specific embodiments thereof, it will be apparent to one skilled in the art that various changes and modifications can be made therein without departing from the spirit and scope thereof. Thus, it is intended that the present description cover the modifications and variations of the apparatus and method provided they come within the scope of the appended claims and their equivalents.

What is claimed is:

1. A sump drain for handling pool water, submerged in a swimming pool having a plastered surface, the sump drain comprising:

a uniformly elongated arcuately convex channel having opposed sidewalls extending between semi-spherically rounded axial ends and a plurality of mutually spaced outlet drain ports disposed inward of the semi-spherically rounded axial ends for guiding water flow therethrough out of the channel, the channel further having an opening for receiving the pool water, the channel being embedded in a surface of the swimming pool and forming a solid surface underneath the opening interrupted only by the plurality of outlet drain ports, the channel defining a plurality of anchor points disposed over bulbous portions of the sidewalls contoured to protrude into the opening for anchoring the sump drain to the plastered surface of the swimming pool underneath;

a water stop abutting and substantially encircling the opening;

the water stop including a trough for retaining and collecting the pool water, the trough defining at least first and second portions endlessly looped about the opening, the first portion projecting laterally from the channel to the second portion extending transversely therefrom;

wherein the sump drain is configured for installation in the pool with the water stop buried in the plastered surface, such that the pool water seeping between the opening and the plastered surface is trapped by the trough, thereby preventing the pool water from intruding beyond the plastered surface;

wherein the mutually spaced outlet drain ports upon partial blockage thereof provide alternate drainage support for one another.

2. The sump drain of claim 1 wherein the channel includes a ledge surface extending peripherally about the opening of the convex channel, the anchor points defining an upper surface coplanar to the ledge surface.

3. The sump drain of claim 1 wherein the first portion of the trough includes a substantially horizontal member extending from the channel, and the second portion of the trough includes a substantially vertical member extending upwardly from the horizontal member.

4. The sump drain of claim 1 wherein the opening includes a rim extending upwardly from the channel.

5. The sump drain of claim 4 wherein the trough is disposed below the rim.

6. An improved non-blockable sump drain for submerged installation in a plastered swimming pool, comprising:

a uniformly elongated arcuately convex channel having semi-spherical rounded axial ends, an opening and a rim, the channel defining a plurality of anchor points disposed over bulbous portions of the sidewalls contoured to protrude into the opening for seating over parts of a surrounding plaster of the swimming pool underneath;

a trough substantially surrounding and abutting the opening, the trough disposed below and outboard the rim, the trough defining at least first and second portions endlessly looped about the opening, the first portion projecting laterally from the channel to the second portion extending transversely therefrom;

a plurality of mutually spaced outlet drain ports disposed in the channel inward of the semi-spherically rounded axial ends for guiding water flow therethrough out of the channel, the channel being embedded in a surface of the swimming pool and forming a solid surface underneath the opening interrupted only by the plurality of outlet drain ports;

wherein the mutually spaced outlet drain ports upon partial blockage thereof provide alternate drainage support for one another;

wherein when the sump drain is configured to be installed in the swimming pool with plaster surrounding the opening, the trough also being covered by plaster such that only the opening is visible;

whereby upon installation pool water is prevented from seeping between the sump drain and the surrounding plaster.

7. A method of preventing pool water from intruding into a supporting wall in a plastered pool adjacent a pool drain comprising:

providing a drain with opposed sidewalls extending between axial ends defining an opening for receiving the pool water;

providing a plurality of mutually spaced outlet drain ports disposed in the drain inward of the semi-spherically rounded axial ends for guiding water flow therethrough out of the drain, the drain being embedded in a surface of the pool and forming a solid surface underneath the opening interrupted only by the plurality of outlet drain ports;

mutually spacing the outlet drain ports to, upon partial blockage thereof, provide alternate drainage support for one another;

abutting a trough to the opening;

securing the drain to the supporting wall;

configuring the drain to define a plurality of anchor points disposed over bulbous portions of the sidewalls contoured to protrude into the opening for anchoring the pool drain to a plaster surface of the swimming pool underneath;

configuring the trough to define at least first and second portions endlessly looped about the opening, the first portion projecting laterally from the drain to the second portion extending transversely therefrom; and substantially surrounding the drain and the trough with plaster;

whereby the pool water is unable to seep between the pool drain and the surrounding plaster.

8. The method of claim 7 wherein the channel includes a ledge surface extending peripherally about the opening of the convex channel, the anchor points defining an upper surface coplanar to the ledge surface.

9. The improved non-blockable sump drain of claim 6 wherein the drain is formed with a ledge surface extending peripherally about the opening, the anchor points being defined with an upper surface coplanar to the ledge surface.

* * * * *